US007784917B2

(12) United States Patent
Bell et al.

(10) Patent No.: US 7,784,917 B2
(45) Date of Patent: Aug. 31, 2010

(54) PROCESS FOR MAKING A MICRO-FLUID EJECTION HEAD STRUCTURE

(75) Inventors: Byron Vencent Bell, Paris, KY (US); Christopher Allen Craft, Paris, KY (US); Bryan Thomas Fannin, Versailles, KY (US); Burton Lee Joyner, II, Lexington, KY (US); Sean Terrence Weaver, Union, KY (US)

(73) Assignee: Lexmark International, Inc., Lexington, KY (US)

( * ) Notice: Subject to any disclaimer, the term of this patent is extended or adjusted under 35 U.S.C. 154(b) by 495 days.

(21) Appl. No.: 11/866,585

(22) Filed: Oct. 3, 2007

(65) Prior Publication Data

US 2009/0091604 A1 Apr. 9, 2009

(51) Int. Cl.
*B41J 2/05* (2006.01)

(52) U.S. Cl. ..... 347/63; 347/56; 347/64

(58) Field of Classification Search ..... 347/20, 347/44, 47, 56, 61–65, 67
See application file for complete search history.

(56) References Cited

U.S. PATENT DOCUMENTS 3,904,453 A 9/1975 Revesz et al.
4,535,343 A * 8/1985 Wright et al. ..... 347/64
5,741,626 A 4/1998 Jain et al.
5,907,333 A 5/1999 Patil et al.
6,004,850 A 12/1999 Lucas et al.
6,239,820 B1 5/2001 Figueredo et al.
6,294,820 B1 9/2001 Lucas et al.
6,614,085 B2 9/2003 Hu
6,627,389 B1 9/2003 Hu
6,753,584 B1 6/2004 Hu
7,178,904 B2 2/2007 Anderson et al.
7,201,464 B2 4/2007 Sekiya
2002/0079558 A1 6/2002 Natarajan et al.

* cited by examiner

*Primary Examiner*—Juanita D Stephens

(57) ABSTRACT

A method of making a micro-fluid ejection head structure and micro-fluid ejection heads made by the method. The method includes applying a tantalum oxide layer to a surface of a fluid ejection actuator disposed on a device surface of a substrate so that the tantalum oxide layer is the topmost layer of a plurality of layers including a resistive layer, and a protective layer selected from a passivation layer, a cavitation layer, and a combination of a passivation layer and a cavitation layer. The tantalum oxide layer has a thickness (t) that satisfies an equation t=(¼*W/n), wherein W is a wavelength of radiation from a radiation source, and n is a refractive index of the tantalum oxide layer. A photoimageable layer is also applied to the substrate. The photoimageable layer is imaged with the radiation source and then developed.

7 Claims, 5 Drawing Sheets

PROCESS FOR MAKING A MICRO-FLUID EJECTION HEAD STRUCTURE

TECHNICAL FIELD

The disclosure relates to micro-fluid ejection devices, and in particular to improved methods for making micro-fluid ejection head structures that have precisely formed flow features.

BACKGROUND AND SUMMARY

Micro-fluid ejection heads are useful for ejecting a variety of fluids including inks, cooling fluids, pharmaceuticals, lubricants and the like. A widely used micro-fluid ejection head is in an ink jet printer. Ink jet printers continue to be improved as the technology for making the micro-fluid ejection heads continues to advance. New techniques are constantly being developed to provide low cost, highly reliable printers which approach the speed and quality of laser printers. An added benefit of ink jet printers is that color images can be produced at a fraction of the cost of laser printers with as good or better quality than laser printers. All of the foregoing benefits exhibited by ink jet printers have also increased the competitiveness of suppliers to provide comparable printers in a more cost efficient manner than their competitors.

One area of improvement in the printers is in the print engine or micro-fluid ejection head itself. This seemingly simple device is a relatively complicated structure containing electrical circuits, ink passageways and a variety of tiny parts assembled with precision to provide a powerful, yet versatile micro-fluid ejection head. The components of the ejection head must cooperate with each other and with a variety of ink formulations to provide the desired print properties. Accordingly, it is important to match the ejection head components to the ink and the duty cycle demanded by the printer. Slight variations in production quality may have a tremendous influence on the product yield and resulting printer performance.

The primary components of a micro-fluid ejection head are a semiconductor substrate, a nozzle plate and a flexible circuit attached to the substrate. The semiconductor substrate is preferably made of silicon and contains various passivation layers, conductive metal layers, resistive layers, insulative layers and protective layers deposited on a device surface thereof. Fluid ejection actuators formed on the device surface may be thermal actuators or piezoelectric actuators. For thermal actuators, individual heater resistors are defined in the resistive layers and each heater resistor corresponds to a nozzle hole in the nozzle plate for heating and ejecting fluid from the ejection head toward a desired substrate or target.

The nozzle plates typically contain hundreds of microscopic nozzle holes for ejecting fluid therefrom. A plurality of nozzle plates are usually fabricated in a polymeric film using laser ablation or other micro-machining techniques. Individual nozzle plates are excised from the film, aligned, and attached to the substrates on a multi-chip wafer using an adhesive so that the nozzle holes align with the heater resistors. The process of forming, aligning, and attaching the nozzle plates to the substrates is a relatively time consuming process and requires specialized equipment.

Fluid chambers and ink feed channels for directing fluid to each of the ejection actuator devices on the semiconductor chip are either formed in the nozzle plate material or in a separate thick film layer. In a center feed design for a top-shooter type micro-fluid ejection head, fluid is supplied to the fluid channels and fluid chambers from a slot or ink via which is formed by chemically etching, dry etching, or grit blasting through the thickness of the semiconductor substrate. The substrate, nozzle plate and flexible circuit assembly is typically bonded to a thermoplastic body using a heat curable and/or radiation curable adhesive to provide a micro-fluid ejection head structure.

In order to decrease the cost and increase the production rate of micro-fluid ejection heads, newer manufacturing techniques using less expensive equipment is desirable. These techniques, however, must be able to produce ejection heads suitable for the increased quality and speed demanded by consumers. As the ejection heads become more complex to meet the increased quality and speed demands of consumers, it becomes more difficult to precisely manufacture parts that meet such demand. Accordingly, there continues to be a need for manufacturing processes and techniques which provide improved micro-fluid ejection head components.

Exemplary embodiments of the disclosure provide a method of making a micro-fluid ejection head structure and micro-fluid ejection heads made by the method. The method includes applying a tantalum oxide layer to a surface of a fluid ejection actuator disposed on a device surface of a substrate so that the tantalum oxide layer is the topmost layer of a plurality of layers including a resistive layer, and a protective layer selected from a passivation layer, a cavitation layer, and a combination of a passivation layer and a cavitation layer. The tantalum oxide layer has a thickness (t) that satisfies an equation $t=(\frac{1}{4}*W/n)$, wherein W is a wavelength of radiation from a radiation source, and n is a refractive index of the tantalum oxide layer. A photoimageable layer is also applied to the substrate. The photoimageable layer is imaged with the radiation source and then developed.

Another exemplary embodiment of the disclosure provides a micro-fluid ejection head. The micro-fluid ejection head has a substrate including at least one ejection actuator, wherein the ejection actuator includes a resistive layer, and at least one protective layer selected from a passivation layer and a cavitation layer. A tantalum oxide layer is disposed as a topmost layer of the ejection actuator. The tantalum oxide layer has a thickness (t) as determined by an equation $t=(\frac{1}{4}*W/n)$, wherein W is a wavelength of radiation from the radiation source, and n is a refractive index of the tantalum oxide layer. At least one photoimageable layer is disposed on the substrate so that the tantalum oxide layer is disposed between the photoimageable layer and the substrate.

In another embodiment there is provided a method for imaging a photoimageable layer attached to a device side of a substrate having fluid ejection actuators on the device side of the substrate. According to the method, a tantalum oxide layer is applied to an exposed surface of the fluid ejection actuators. The tantalum oxide layer has a thickness sufficient to absorb radiation used to image the photoimageable layer. The fluid ejection actuators include at least one resistive layer and at least one protective layer disposed on the resistive layer. A photoimageable layer is also applied to the device side of the substrate. The photoimageable layer is imaged with a radiation source to provide fluid flow features therein.

An advantage of the embodiments described herein is that they may provide an improved micro-fluid ejection head structures and, in particular, improved nozzle plates and thick film layers for micro-fluid ejection heads. Another advantage is that the methods may enable the formation of nozzle holes, fluid ejection chambers, and fluid flow channels that have precise sizes and shapes. Other advantages of the embodiments described herein may include improved protection of the fluid ejection actuators by the presence of the tantalum oxide layer on an exposed surface of the fluid ejection actuators.

BRIEF DESCRIPTION OF THE DRAWINGS

Further features and advantages of the disclosed embodiments will become apparent by reference to the detailed description when considered in conjunction with the figures, which are not to scale, wherein like reference numbers indicate like elements through the several views, and wherein.

DETAILED DESCRIPTION OF THE EMBODIMENTS

Figure 1:
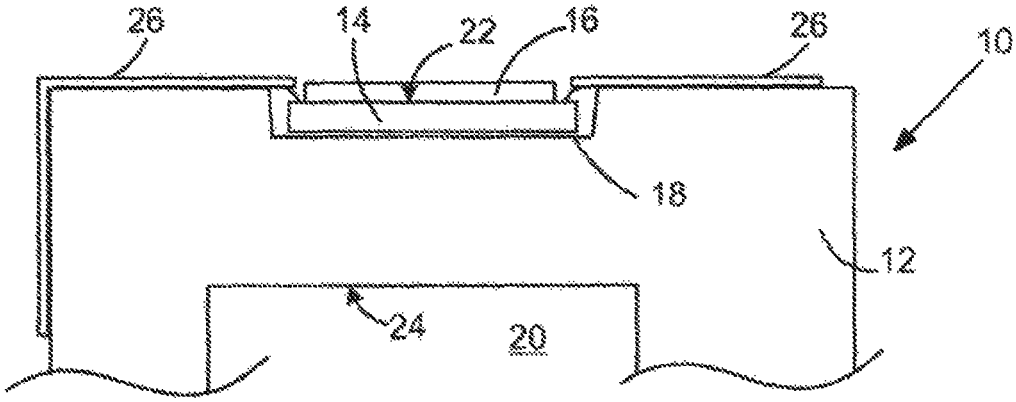
FIG. 1 is a cross-sectional view, not to scale, of a portions of a micro-fluid ejection head according to the disclosure.

With reference to FIG. 1, there is shown a simplified representation of a portion of an exemplary micro-fluid ejection head 10, for example an ink jet printhead, viewed from one side and attached to a fluid cartridge body 12. The ejection head 10 includes a substrate 14 and a nozzle plate 16 attached to the substrate. The substrate/nozzle plate assembly 14/16 is attached in a chip pocket 18 in the cartridge body 12 to form the ejection head 10. Fluid to be ejected, such as an ink, is supplied to the substrate/nozzle plate assembly 14/16 from a fluid reservoir 20 in the cartridge body 12 generally opposite the chip pocket 18.

The cartridge body 12 may preferably be made of a metal or a polymeric material selected from the group consisting of amorphous thermoplastic polyetherimide available from G.E. Plastics of Huntersville, N.C. under the trade name ULTEM 1010, glass filled thermoplastic polyethylene terephthalate resin available from E. I. du Pont de Nemours and Company of Wilmington, Del. under the trade name RYNITE, syndiotactic polystyrene containing glass fiber available from Dow Chemical Company of Midland, Mich. under the trade name QUESTRA, polyphenylene oxide/high impact polystyrene resin blend available from G.E. Plastics under the trade names NORYL SE1 and polyamide/polyphenylene ether resin available from G.E. Plastics under the trade name NORYL GTX. One polymeric material for making the cartridge body 12 is NORYL SE1 polymer.

The semiconductor substrate 14 is preferably a silicon semiconductor substrate 14 containing a plurality of fluid ejection actuators such as piezoelectric devices or heater resistors formed on a device side 22 of the substrate 14. Upon activation of heater resistors, fluid supplied through one or more fluid supply slots in the semiconductor substrate 14 is caused to be ejected through nozzle holes in the nozzle plate 16. Fluid ejection actuators, such as heater resistors, are formed on the device side 22 of the substrate 14 by well known semiconductor manufacturing techniques.

The substrates 14 are relatively small in size and typically have overall dimensions ranging from about 2 to about 8 millimeters wide by about 10 to about 20 millimeters long and from about 0.4 to about 0.8 mm thick. The substrates may be made of silicon, ceramic, semiconductor materials, or a combination of silicon and ceramic materials. The fluid supply slots may be grit-blasted or etched in the semiconductor substrates 14 using chemical or dry etching techniques. A particularly suitable etching technique is deep reactive ion etching. Such slots typically have dimensions of about 9.7 millimeters long and 0.39 millimeters wide. Fluid may be provided to the fluid ejection actuators by a single one of the slots or by a plurality of openings in the substrate 14.

The fluid supply slots direct fluid from the reservoir 20 which is located adjacent fluid surface 24 of the cartridge body 12 (FIG. 1) through a passage-way in the cartridge body 12 and through the fluid supply slots in the substrate 14 to the device side 22 of the substrate 14. The device side 22 of the substrate 14 also may contain one or more metal layers providing electrical tracing from the fluid ejection actuators to contact pads used for connecting the substrate 14 to a flexible circuit or a tape automated bonding (TAB) circuit 26 (FIG. 1). The TAB circuit 26 supplies electrical impulses from a fluid ejection controller to activate one or more of the fluid ejection actuators on the substrate 14.

Figure 2:
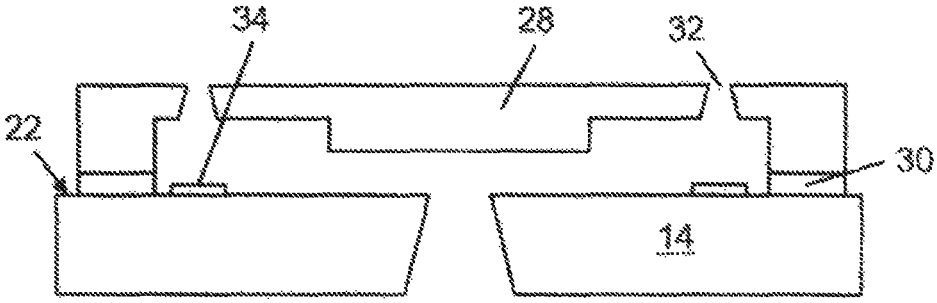
FIG. 2 Prior Art
FIG. 2 is an enlarged cross-sectional view, not to scale, of a portion of a prior art micro-fluid ejection head.

In some prior art ejection heads, as illustrated in FIG. 2, a nozzle plate 28 is formed in a film, excised from the film and attached as a separate component to the semiconductor substrate 14 using an adhesive 30. The nozzle plate 28 is attached to the substrate 14 prior to attaching the substrate 14 to the cartridge body 112. The adhesive 30 typically used to attach the nozzle plate 28 to the substrate 14 is a heat curable adhesive such as a B-stageable thermal cure resin, including, but not limited to phenolic resins, resorcinol resins, epoxy resins, ethylene-urea resins, furane resins, polyurethane resins and silicone resins. The nozzle plate adhesive 30 is suitably cured before attaching the substrate/nozzle plate assembly 14/28 to the cartridge body 12.

In the prior art ejection heads, excised nozzle plates 28 are attached to a wafer containing a plurality of substrates 14. An automated device is used to optically align nozzle holes 32 in each of the nozzle plates 28 with fluid ejection actuators, such as heater resistors 34, on the substrates 14 and attach the nozzle plates 28 to the substrates 14. Misalignment between the nozzle holes 32 and the heater resistors 34 may cause problems such as misdirection of ink droplets from the ejection head, inadequate droplet volume or insufficient droplet velocity. The laser ablation equipment and automated nozzle plate attachment devices are costly to purchase and maintain. Furthermore it is often difficult to maintain manufacturing tolerances using such equipment in a high speed production process. Slight variations in the manufacture of each unassembled component are magnified significantly when coupled with machine alignment tolerances to decrease the yield of micro-fluid ejection head assemblies.

Figure 3A:
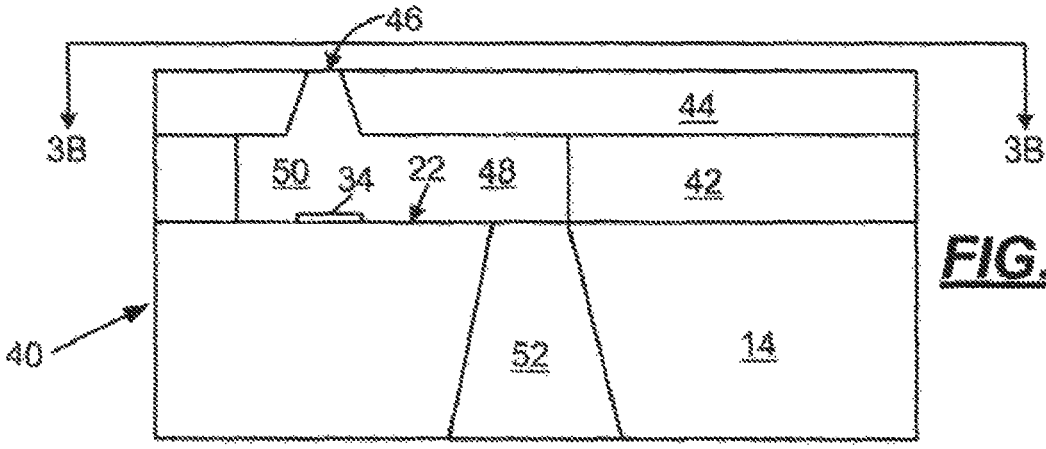
FIG. 3A is an enlarged cross-sectional view, not to scale, of a portion of a micro-fluid ejection head according to an embodiment of the disclosure.
Figure 3B:
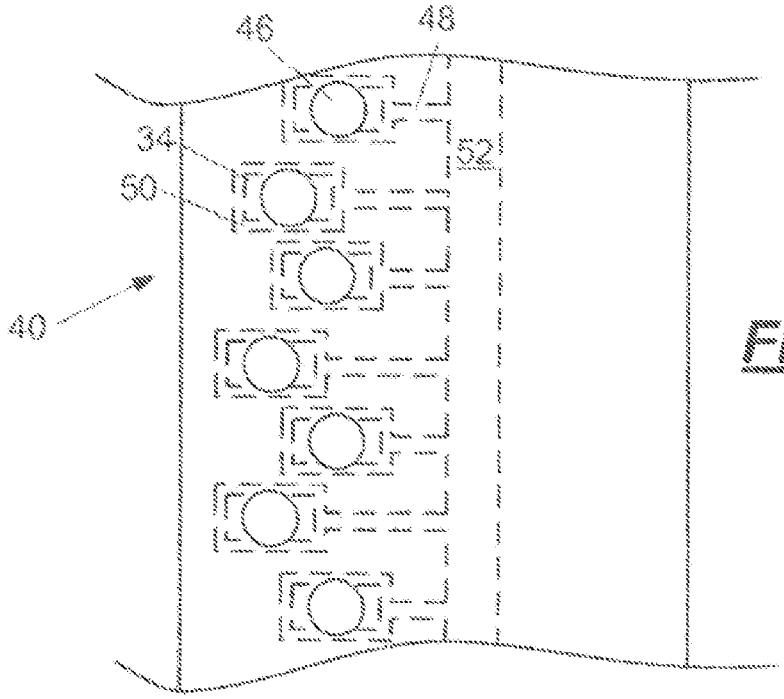
FIG. 3B is a plan view, not to scale, of a portion of the micro-fluid ejection head of FIG. 3A.
Figure 5:
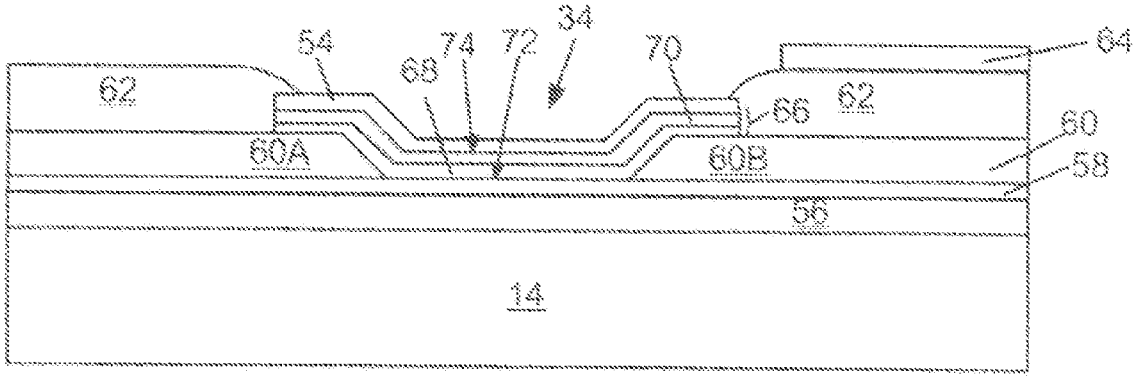
FIGS. 5-9 are schematic views, not to scale, of steps in processes for making micro-fluid ejection heads according to the disclosure.

An improved micro-fluid ejection head structure 40 is illustrated in FIGS. 3A and 3B. Unlike the prior art structure illustrated in FIG. 2, the improved micro-fluid ejection head 40 includes a thick film layer 42 and a separate nozzle plate layer 44. A feature of the embodiment of FIG. 3A that improves the alignment tolerances between nozzle holes 46 in the nozzle plate layer 44 and the fluid ejection actuators 34 is that the nozzle holes 46 are formed in the nozzle plate layer 44 after the nozzle plate layer 44 is attached to the thick film layer 42. Imaging the nozzle holes 46 after attaching a nozzle plate material to the thick film layer 42 enables placement of the nozzle holes 46 in an optimum location for each of the fluid ejector actuators 34.

According to the embodiment illustrated in FIG. 3A, a laser ablatable or photoimageable nozzle plate layer 44 is attached to the thick film layer 42 that is attached to the device surface 22 of the substrate 14. The thick film layer 42 has been previously imaged to provide fluid flow channels 48 and fluid ejection chambers 50 therein. Fluid is provided to the fluid flow channels 48 and ejection chambers 50 through one or more openings or slots 52 in the substrate 14.

By way of example, a positive or negative photoresist material may be spin coated, spray coated, laminated or adhesively attached to the device surface 22 of the substrate 14 to provide the thick film layer 42. After imaging the photoresist material and before or after developing the photoresist material, the nozzle plate layer 44 is attached to the thick film layer. After attaching the nozzle plate layer 44 to the thick film layer 42, the nozzle holes 46 are formed in the nozzle plate layer 44. The nozzle holes 46 typically have an inlet diameter ranging from about 10 to about 50 microns, and an outlet diameter ranging from about 6 to about 40 microns. A plan view of the micro-fluid ejection head 40 containing a plurality of ejection actuators 34, fluid chambers 50, fluid channels 48, and nozzle holes 46 (i.e., flow features) is illustrated in FIG. 3B. Due to the size of the nozzle holes, even slight variations or imperfections may have a tremendous impact on the performance of the micro-fluid ejection head 40.

One difficulty faced by manufacturers of the micro-fluid ejection heads 40 described above is that during the formation of the nozzle holes 46, fluid flow channels 48, and/or fluid ejection chambers 50, with laser or ultraviolet imaging techniques, radiation is scattered and/or reflected by the fluid ejection actuators 34 and/or device surface 22 of the substrate 14. Such radiation may be effective to distort the size of the nozzle holes 46 or form irregular nozzle hole shapes. Conventional, anti-reflective coatings applied to the device surface 22 of the substrate 14 cannot be used since such coatings may cause delamination of the thick film layer 42 from the substrate 14, and may impact fluid flow properties and fluid ejection properties of the heater resistors 34.

Accordingly, embodiments of the disclosure, described and illustrated in more detail below, provide improved methods for reducing scattering or reflection of radiation by the fluid ejection actuators 34 and/or device surface 22 of the substrate 14 during imaging of the thick film layer 42 and/or nozzle hole formation in the nozzle plate layer 44. According to an exemplary embodiment of the disclosure, scattering and/or reflection of radiation from the ejection actuators 34 and/or device surface 22 of the substrate 14 is substantially reduced by use of a predetermined thickness of a tantalum oxide material. The tantalum oxide material may be tantalum pentoxide ($Ta_2O_5$) having a thickness as determined by the following equation:

$$t=(1/4*W/n)$$

wherein t is the thickness of the tantalum oxide layer, W is a wavelength of radiation used to image the thick film layer 42 and/or nozzle plate layer 44, and n is the refractive index of the tantalum oxide material at the wavelength used. For purposes of this disclosure, the refractive index (n) of the tantalum oxide layer ranges from about 2.0 to about 2.5 in a wavelength range of from about 300 to about 500 nanometers.

Figure 4:
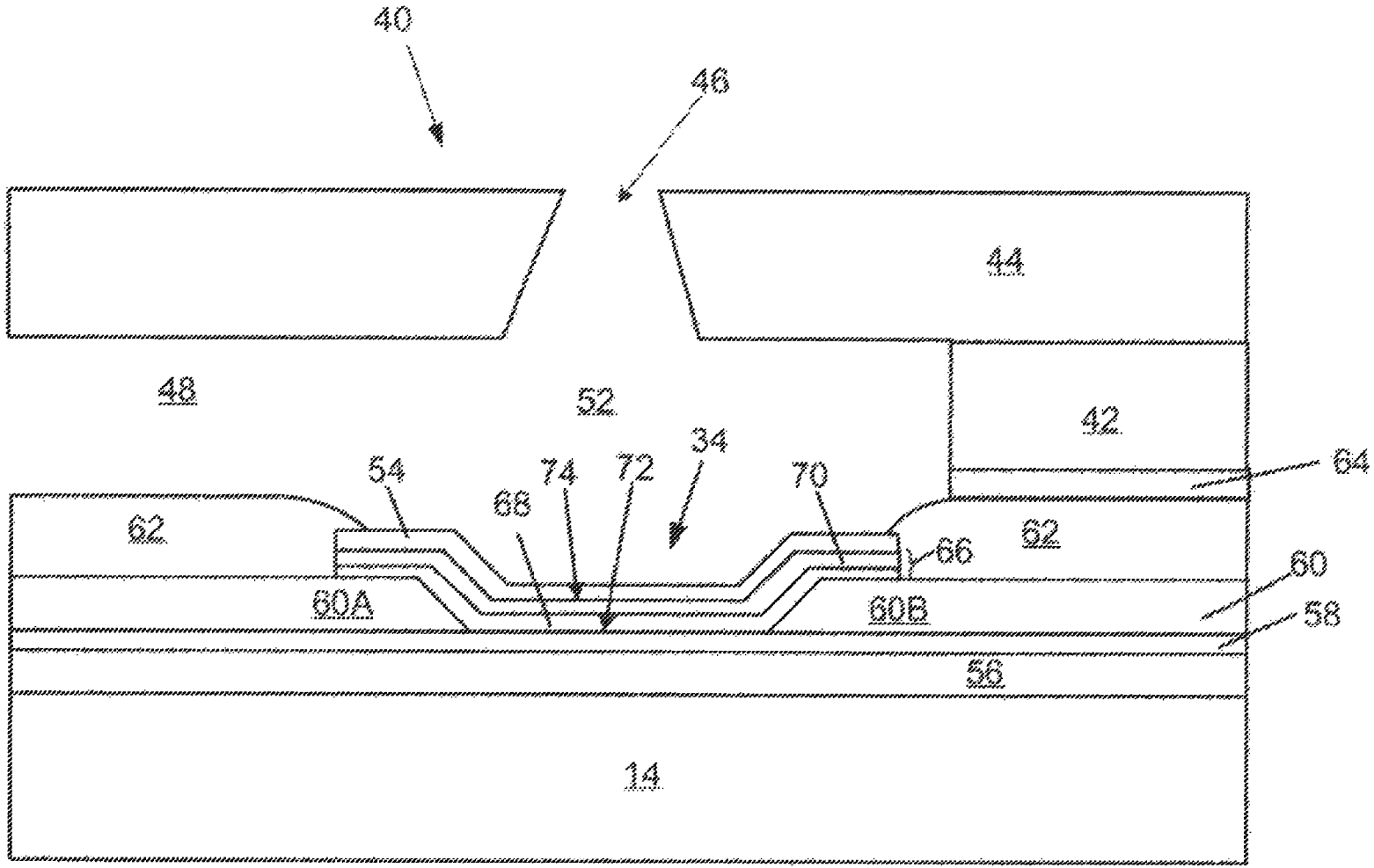
FIG. 4 is a cross-sectional view, not to scale, of a portion of an ejection head according to the disclosure illustrating more details of the ejection head structure.

A portion of a micro-fluid ejection head 40, illustrating the use of the tantalum oxide layer 54 on a fluid ejection actuator 34 is illustrated in FIG. 4. As shown in FIG. 4, the substrate 14 includes a thermal insulating layer 56 and a resistive layer 58. The thermal insulation layer 56 may be formed from a thin layer of silicon dioxide and/or doped silicon glass overlying the relatively thick silicon substrate 14. The total thickness of the thermal insulation layer 56 may range from about 1 to about 3 microns thick. The underlying silicon substrate 14 may have a thickness ranging from about 200 microns to about 1000 microns thick.

A first metal conductive layer 60 is attached to the resistive layer 58 and is etched to provide electrodes 60A and 60B thereby defining the fluid ejection actuator 34. The first metal conductive layer 60 is typically selected from conductive metals, including but not limited to, gold, aluminum, silver, copper, and the like and has a thickness ranging from about 4,000 to about 15,000 Angstroms.

Overlying the power and ground conductors 60A and 60B is another insulating layer or dielectric layer 62 typically composed of epoxy photoresist materials, polyimide materials, silicon nitride, silicon carbide, silicon dioxide, spun-on-glass (SOG), laminated polymer and the like. The insulating layer 62 and has a thickness ranging from about 5,000 to about 20,000 Angstroms and provides insulation between a second metal layer 64 and the first metal conductive layer 60.

The fluid ejection actuators 34 may be formed from an electrically resistive material layer 58, such as TaAl, Ta2N, Ta4Al(O,N), TaAlSi, TaSiC, Ti(N,O), Wsi(O,N), TaAlN, and TaAl/Ta. The thickness of the resistive material layer 58 may range from about 500 to about 1000 Angstroms.

In order to protect the resistive layer 58 from mechanical and chemical damage caused by the fluid ejected from the ejection head 40, one or more protective layers 66 selected from a passivation layer 68 and a cavitation layer 70 are applied to a surface 72 of the resistive layer 58. The protective layers 66 are effective to prevent the fluid or other contaminants from adversely affecting the operation and electrical properties of the fluid ejection actuators 34 and provide protection from mechanical abrasion or shock from fluid bubble collapse.

The passivation layer 68 may be formed from a dielectric material, such as silicon nitride, or silicon doped diamond-like carbon (Si-DLC) having a thickness of from about 1000 to about 3200 Angstroms thick. The passivation layer 68 may include more than one layer of material. For example, silicon carbide having a thickness from about 500 to about 1500 Angstroms thick may be used in combination with a silicon nitride or Si-DLC layer. The overall thickness of the passivation layers 68 typically ranges from about 1500 to about 5000 Angstroms.

The cavitation layer 70 is typically formed from tantalum having a thickness greater than about 500 Angstroms thick. The cavitation layer 70 may also be made of TaB, Ti, TiW, TiN, WSi, or any other material with a similar thermal capacitance and relatively high hardness. The maximum thickness of the cavitation layer 70 is such that the total thickness of protective layer 66 is less than about 7200 Angstroms thick. The total thickness of the protective layer 66 is defined as a distance from a surface 72 of the resistive material layer 58 to an exposed surface 74 of the protective layer 66.

Methods for making micro-fluid ejection heads 40 according to embodiments of the disclosure will now be described with reference to FIGS. 5-14. According to FIG. 5, a tantalum oxide layer 54 is applied to the exposed surface 74 of the fluid ejector actuator 34 and/or to any of the exposed second metal conductive layer 64. The tantalum oxide layer 54 may be applied to the substrate 14 in predetermined locations such as the ejection actuator 34 and second metal conductive layer 64 by a chemical vapor deposition (CVD) process. In one alternative embodiment, the tantalum oxide layer 54 may be formed by reactive ion sputtering (RIS) the metallic atoms from a sputter target through an oxygen-containing atmosphere. In another alternative embodiment, when the cavitation layer 70 is composed of tantalum, a portion of the cavitation layer 70 may be oxidized by an oxidation atmosphere to provide the tantalum oxide layer 54.

Figure 6:
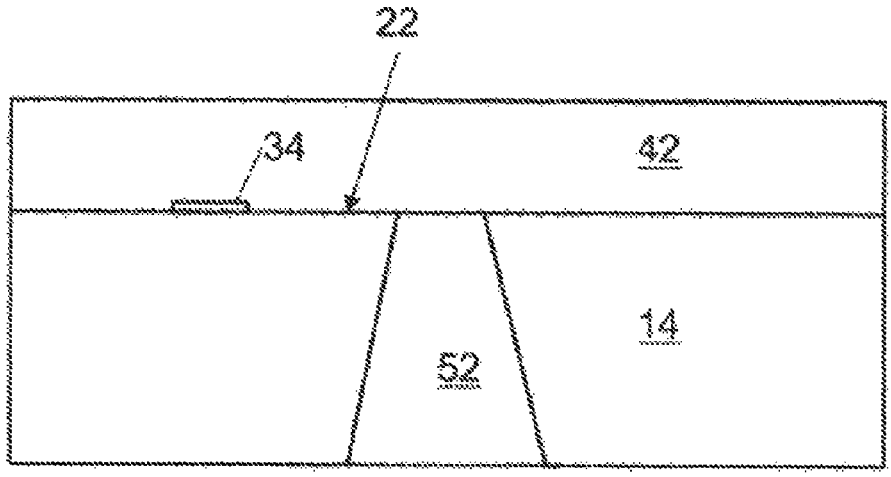

After applying the tantalum oxide layer 54 to the substrate 14, a positive or negative photoresist material is applied to the device surface 22 of the substrate 14 before or after forming the fluid supply slot 52 in the substrate 14 to provide the thick film layer 42 as shown in FIG. 6. The thick film layer 42 has a thickness typically ranging from about 10 to about 25 microns. Suitable positive or negative photoresist materials that may be used for layer 42 include, but are not limited to acrylic and epoxy-based photoresists such as the photoresist materials available from Clariant Corporation of Somerville, N.J. under the trade names AZ4620 and AZ1512. Other photoresist materials are available from Shell Chemical Company of Houston, Tex. under the trade name EPON SU8 and photoresist materials available Olin Hunt Specialty Products, Inc. which is a subsidiary of the Olin Corporation of West Paterson, N.J. under the trade name WAYCOAT. A particularly suitable photoresist material includes from about 10 to about 20 percent by weight difunctional epoxy compound, less than about 4.5 percent by weight multifunctional crosslinking epoxy compound, from about 1 to about 10 percent by weight photoinitiator capable of generating a cation and from about 20 to about 90 percent by weight non-photoreactive solvent as described in U.S. Pat. No. 5,907,333 to Patil et al., the disclosure of which is incorporated by reference herein as if fully set forth herein.

The multi-functional epoxy component of the photoresist formulation used for providing the thick film layer 42 may have a weight average molecular weight of about 3,000 to about 5,000 Daltons as determined by gel permeation chromatography, and an average epoxide group functionality of greater than 3, such as from about 6 to about 10. The amount of multifunctional epoxy resin in the photoresist formulation for the thick film layer 42 usually ranges from about 30 to about 50 percent by weight based on the weight of the cured thick film layer 42.

A second component of the photoresist formulation for the thick film layer 42 is the di-functional epoxy compound. The di-functional epoxy component may be selected from di-functional epoxy compounds which include diglycidyl ethers of bisphenol-A (e.g. those available under the trade designations "EPON 1007F", "EPON 1007" and "EPON 1009F", available from Shell Chemical Company of Houston, Tex., "DER-331", "DER-332", and "DER-334", available from Dow Chemical Company of Midland, Mich., 3,4-epoxycyclohexylmethyl-3,4-epoxycyclo-hexene carboxylate (e.g. "ERL-4221" available from Union Carbide Corporation of Danbury, Conn., 3,4-epoxy-6-methylcyclohexylmethyl-3,4-epoxy-6-methylcy-clohexene carboxylate (e.g. "ERL-4201" available from Union Carbide Corporation), bis(3,4-epoxy-6-methylcyclohexylmethyl) adipate (e.g. "ERL-4289" available from Union Carbide Corporation), and bis(2,3-epoxycyclopentyl)ether (e.g. "ERL-0400" available from Union Carbide Corporation.

One first di-functional epoxy component is a bisphenol-A/epichlorohydrin epoxy resin available from Shell Chemical Company of Houston, Tex. under the trade name EPON resin 1007F having an epoxide equivalent of greater than about 1000. An "epoxide equivalent" is the number of grams of resin containing 1 gram-equivalent of epoxide. The weight average molecular weight of the di-functional epoxy component is typically above 2500 Daltons, e.g., from about 2800 to about 3500 weight average molecular weight. The amount of the di-functional epoxy component in the thick film photoresist formulation may range from about 30 to about 50 percent by weight based on the weight of the cured resin.

The photoresist formulation for the thick film layer 42 may also include a photoacid generator devoid of aryl sulfonium salts. The photoacid generator is suitably a compound or mixture of compounds capable of generating a cation such as an aromatic complex salt which may be selected from onium salts of a Group VA element, onium salts of a Group VIA element, and aromatic halonium salts. Aromatic complex salts, upon being exposed to ultraviolet radiation or electron beam irradiation, are capable of generating acid moieties which initiate reactions with epoxides. The photoacid generator may be present in the photoresist formulation for the thick film layer 42 in an amount ranging from about 5 to about 15 weight percent based on the weight of the cured resin.

Of the aromatic complex salts which are suitable for use in exemplary photoresist formulation disclosed herein, suitable salts are di- and triaryl-substituted iodonium salts. Examples of aryl-substituted iodonium complex salt photoacid generators include, but are not limited to:

diphenyliodonium trifluoromethanesulfonate,
(p-tert-butoxyphenyl)phenyliodonium trifluoromethanesulfonate,
diphenyliodonium p-toluenesulfonate,
(p-tert-butoxyphenyl)-phenyliodonium p-toluenesulfonate,
bis(4-tert-butylphenyl)iodonium hexafluorophosphate, and
diphenyliodonium hexafluoroantimonate.

One iodonium salt for use as a photoacid generator for the embodiments described herein is a mixture of diaryliodonium hexafluoroantimonate salts, commercially available from Sartomer Company, Inc. of Exton, Pa. under the trade name SARCAT CD 1012

The photoresist formulation for the thick film layer 42 may optionally include an effective amount of an adhesion enhancing agent such as a silane compound. Silane compounds that are compatible with the components of the photoresist formulation typically have a functional group capable of reacting with at least one member selected from the group consisting of the multifunctional epoxy compound, the difunctional epoxy compound and the photoinitiator. Such an adhesion enhancing agent may be a silane with an epoxide functional group such as a glycidoxyalkyltrialkoxysilane, e.g., gamma-glycidoxypropyltrimethoxysilane. When used, the adhesion enhancing agent may be present in an amount ranging from about 0.5 to about 2 weight percent and, in some embodiments, from about 1.0 to about 1.5 weight percent based on total weight of the cured resin, including all ranges subsumed therein. Adhesion enhancing agents, as used herein, are defined to mean organic materials soluble in the photoresist composition which assist the film forming and adhesion characteristics of the thick film layer 42 on the device surface 22 of the substrate 14.

The thick film layer 42 may be applied to the device surface 22 of the substrate by a variety of conventional semiconductor processing techniques, including but not limited to, spin-coating, roll-coating, spraying, dry lamination, adhesives and the like. A method includes spin coating the resin formulation onto the device surface 22 of the substrate 14 by use of a solvent. A suitable solvent is a solvent which is preferably non-photoreactive. Non-photoreactive solvents include, but are not limited gamma-butyrolactone, $C_{1-6}$ acetates, tetrahydrofuran, low molecular weight ketones, mixtures thereof and the like. A suitable non-photoreactive solvent is acetophenone. The non-photoreactive solvent is present in the formulation mixture used to provide the thick film layer 42 in an amount ranging of from about 20 to about 90 weight percent, in some embodiments, from about 40 to about 60 weight percent, based on the total weight of the photoresist formulation. The non-photoreactive solvent typically does not remain in the cured thick film layer 42 and is thus is removed prior to or during the thick film layer 42 curing steps.

A method for imaging the thick film layer 42 will now be described with reference to FIGS. 7-8. In order to define the fluid chambers 50 and fluid flow channels 48 in the thick film layer 42, the layer 42 is masked with a mask 76 containing substantially transparent areas 78 and substantially opaque areas 80 thereon. Areas of the thick film layer 42 masked by the opaque areas 80 of the mask 76 will be removed upon developing the thick film layer 42 to provide the fluid chambers 50 and flow channels 48 described above.

A radiation source provides actinic radiation indicated by arrows 82 to image the thick film layer 42. A suitable source of radiation emits actinic radiation at a wavelength within the ultraviolet and visible spectral regions. Exposure of the thick film layer 42 may be from less than about 1 second to 10 minutes or more, typically about 5 seconds to about one minute, depending upon the amounts of particular epoxy materials and aromatic complex salts being used in the formulation and depending upon the radiation source, distance from the radiation source, and the thickness of the thick film layer 42. The thick film layer 42 may optionally be exposed to electron beam irradiation instead of ultraviolet radiation.

The foregoing procedure is similar to a standard semiconductor lithographic process. The mask 76 is a clear, flat substrate usually glass or quartz with the opaque areas 80 defining areas of the thick film layer 42 that are to removed after development. The opaque areas 80 prevent the ultraviolet light from contacting the thick film layer 42 masked beneath it so that such areas remain soluble in a developer. The exposed areas of the layer 42 provided by the substantially transparent areas 78 of the mask 76 are reacted and therefore rendered insoluble in the developer. The solubilized material is removed leaving the imaged and developed thick film layer 42 on the device surface 22 of the substrate 14 as shown in FIG. 8. The developer comes in contact with the substrate 14 and thick film layer 42 through either immersion and agitation in a tank-like setup or by spraying the developer on the substrate 14 and thick film layer 42. Either spray or immersion will adequately remove the imaged material. Illustrative developers include, for example, butyl cellosolve acetate, a xylene and butyl cellosolve acetate mixture, and $C_{1-6}$ acetates like butyl acetate.

In a next step of a process for making the ejection head 40, the nozzle plate layer 44 is applied to the imaged and developed thick film layer 42. In the alternative, the thick film layer 42 may be imaged, but not developed prior to applying the nozzle plate layer 44 to the thick film layer 42. Accordingly, the nozzle plate layer 44 may be laminated to the thick film layer 42 after the thick film layer 42 is developed or may be spin coated onto the thick film layer 42 before the thick film layer 42 is developed.

The nozzle plate layer 44 may be made of the same or similar materials as the thick film layer 42 described above. Particularly desirable nozzle plate layers 44 may be selected from positive or negative photoresist materials. Once the nozzle plate layer 44 is applied to the thick film layer 42, a second mask 84 containing opaque areas 86 and transparent area 88 is used to define the nozzle hole location 90 in the nozzle plate layer 44 using a radiation source indicated by arrows 92.

Figure 7:
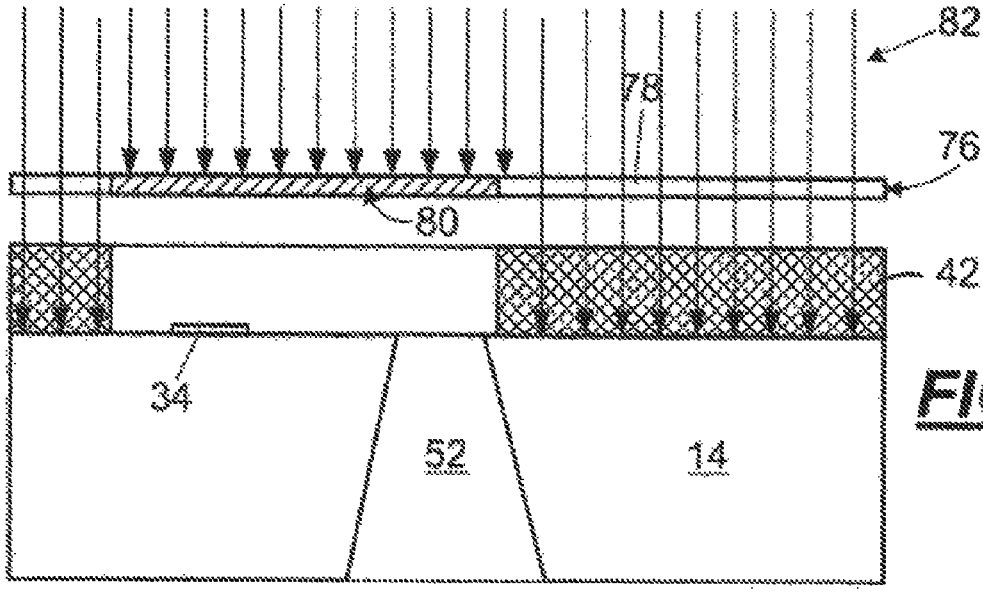
Figure 8:
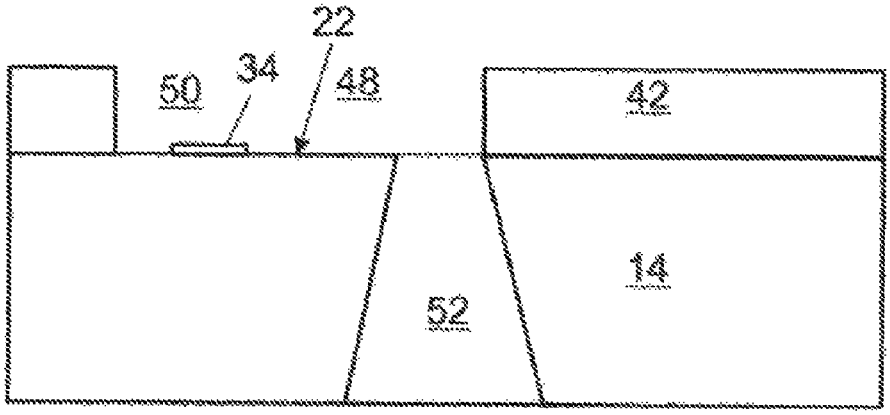
Figure 9:
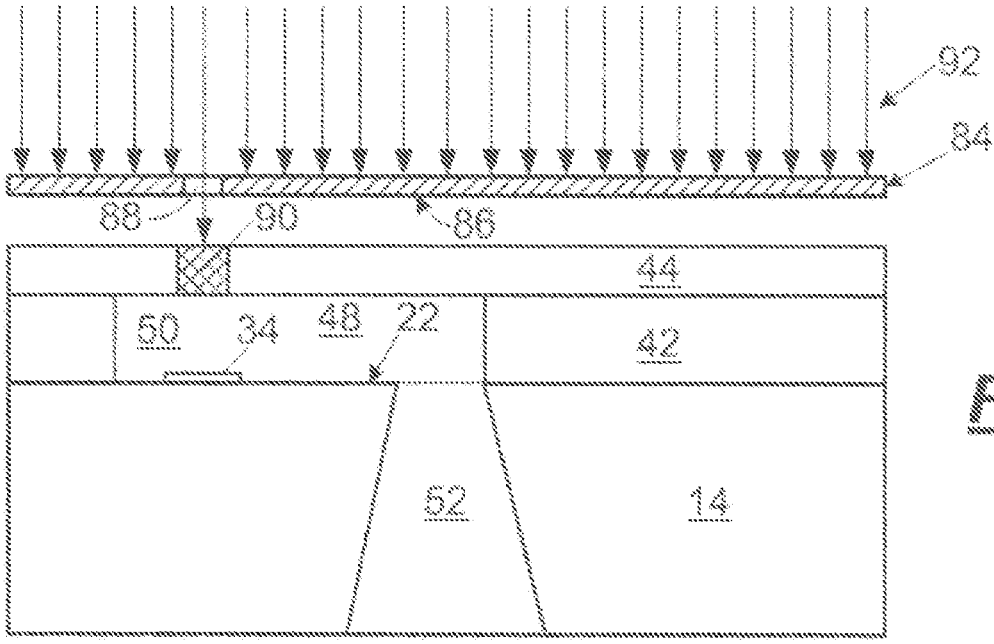

In order to reduce reflected radiation during thick film imaging step illustrated in FIG. 7 or the nozzle hole imaging step illustrated in FIG. 9, the tantalum oxide layer 54 is applied to the ejection actuator 34 and/or over the second metal conductive layer 64 on the device surface 22 of the substrate 14

Areas of the substrate surface 22 that are, in some embodiments, covered by the tantalum oxide layer 54 include the fluid ejection actuator 34, the second metal conductive layer 64, and electrical contact pad areas (not shown).

Having described various aspects and embodiments of the disclosure and several advantages thereof, it will be recognized by those of ordinary skills that the embodiments are susceptible to various modifications, substitutions and revisions within the spirit and scope of the appended claims.

What is claimed is:

1. A micro-fluid ejection head, comprising:

a substrate including at least one ejection actuator, wherein the ejection actuator includes a resistive layer, and at least one protective layer selected from a passivation layer and a cavitation layer;

a tantalum oxide layer disposed as a topmost layer of the ejection actuator having a thickness (t) as determined by an equation $t=(\frac{1}{4}*W/n)$, wherein W is a wavelength of radiation from a radiation source, and n is a refractive index of the tantalum oxide layer; and at least one photoimageable layer disposed on the substrate so that the tantalum oxide layer is disposed between the photoimageable layer and the substrate.

2. The ejection head of claim 1, wherein the tantalum oxide layer is disposed between a metal layer on the surface of the substrate and the photoimageable layer.

3. The ejection head of claim 1, wherein the photoimageable layer comprises a thick film layer that is imaged to provide fluid ejection chambers and fluid flow channels therein for flow of fluid to the fluid ejection actuator.

4. The ejection head of claim 1, wherein the photoimageable layer comprises a nozzle plate layer that is imaged to provide fluid ejection orifices therein.

5. The ejection head of claim 1, wherein the tantalum oxide layer has a thickness (t) ranging from about 300 Angstroms to about 5000 Angstroms.

6. The ejection head of claim 1, wherein tantalum oxide layer comprises an oxidized portion of a tantalum cavitation layer of the fluid ejection actuator.

7. The ejection head of claim 1, wherein the refractive index (n) of the tantalum oxide layer ranges from about 2.0 to about 2.5 in a wavelength range of from about 300 to about 500 nanometers.

* * * * *